US006032426A

United States Patent [19]

Tamlyn

[11] Patent Number: 6,032,426

[45] **Date of Patent: *Mar. 7, 2000**

[54] VERTICAL SIDING PANEL PROTECTIVE STRIP

[76] Inventor: John Thomas Tamlyn, 10406 Cash Rd., Stafford, Tex. 77477-4492

[ * ] Notice: This patent issued on a continued prosecution application filed under 37 CFR 1.53(d), and is subject to the twenty year patent term provisions of 35 U.S.C. 154(a)(2).

[21] Appl. No.: 08/958,551

[22] Filed: Oct. 29, 1997

[51] Int. Cl.[7] ..... E04B 2/30

[52] U.S. Cl. ..... 52/483.1; 52/287.1; 52/460; 52/464; 52/506.06

[58] Field of Search ..... 52/204.593, 204.595, 52/235, 287.1, 460, 464, 468, 483.1, 716.1, 781.3, 506.06, 506.07, 508, 513; 403/167, 168, 231, 403

[56] References Cited

U.S. PATENT DOCUMENTS

| | | | |
|---|---|---|---|
| 1,709,300 | 4/1929 | Barclay | 52/464 |
| 2,604,061 | 7/1952 | Estey | 52/204.593 |
| 3,857,216 | 12/1974 | Sherman | 52/506.06 |
| 4,067,155 | 1/1978 | Ruff et al. | 52/287.1 X |
| 4,229,913 | 10/1980 | Corrigan | 52/506.06 X |
| 4,624,088 | 11/1986 | Arent | 52/506.07 |
| 4,650,702 | 3/1987 | Whitmyer | 52/204.593 X |
| 4,691,489 | 9/1987 | Shea, Jr. | 52/204.593 X |
| 4,835,916 | 6/1989 | Steadman | 52/506.06 X |
| 4,924,647 | 5/1990 | Drucker | 52/235 |
| 5,026,581 | 6/1991 | Shea, Jr. et al. | 52/204.593 X |
| 5,651,225 | 7/1997 | Leeks | 52/468 X |

*Primary Examiner*—Carl D. Friedman
*Assistant Examiner*—Kevin D. Wilkens
*Attorney, Agent, or Firm*—Gunn & Associates, P.C.

[57] ABSTRACT

A prefab building protective system is disclosed, where the building includes multiple frame members supporting an exterior water shedding skin formed of adjacent panels. Two adjacent panels define a seam thereby where rain water leakage may occur. The present invention involves a T-strip having a back plate with width equal to or greater than the width of a frame members, and supporting an upstanding spline sufficient in height to extend through the spacing between adjacent panel members abutted against both faces of the spline.

10 Claims, 2 Drawing Sheets

VERTICAL SIDING PANEL PROTECTIVE STRIP

BACKGROUND OF THE DISCLOSURE

This disclosure is directed to a protective strip for attachment to the vertical siding in prefabricated housing exemplified by mobile homes. Prefab or factory assembled housing takes advantage of a number of light-weight materials and utilizes light-weight construction. Generally, it is constructed with a multiple layer wall having frame members in it which are erected with regular vertical frame members. The frame members extend between upper and lower frame members and define a support adjacent to an outer wall seam. The layers which form the structure are fabricated on top of it. In one aspect, the exterior shell normally is formed of water impervious sheet material. The sheet material is typically a selected clad vinyl, vinyl covered aluminum, particle board, hard surfaced composition sheeting such as FORMICA and similar products. All of these will be described as the outside or exposed panel which will be defined, for purposes of this disclosure, as the weather panel. In that, it must be water proof material. A more recent product which is highly desirable is the fibre-cement panel material which is provided by the James Hardie Building Products Company. Other panels include hardboard and composition sheet products sold under the brand name of MASONITE. Generally speaking, these panels are assembled with butting edges to define a seam.

With supportive framing and regular installation of the weather panels on the exterior, there is the serious likelihood of leakage along the seam between adjacent panels. These seams are vertical. The vertical seams are often exposed to rain which may fall at an angle to impinge on the side wall. Prefab buildings and mobile homes are generally constructed without an eave overhanging the wall which otherwise keeps the rain water off. As the rain impinges on the structure, a real risk is running down the side of the wall to seep into the narrow slot between adjacent weather panels. In fact, a narrow slot which is quite thin, will serve almost as a capillary, tending to draw water and permitting the water to flow to the inside region behind the seam. When water gets behind the wall, there is a serious risk of water damage which can readily be permanent.

The prefab industry (and others in mobile homes and the like) do not routinely position felt paper behind the seams. Generally, the main defense against water intrusion at the seams is caulking from the exterior to prevent water entry into the seams.

The present disclosure sets forth a system by which water can be excluded from these seams. It is possible to fill these seams from the exterior. The seams are most commonly filled from the exterior with semi-soft caulking material typically applied with a caulking gun. While that will last perhaps a few years, it often becomes brittle and readily fractures on structural shifting. Structural shifting is substantially an assured event which occurs especially with prefab buildings. For one thing, they are built at one location and moved over streets and roads to another location. When subjected to the bumps of highway traffic, shock loading occurs and there may be a fraction of an inch shift where adjacent occurs, which otherwise define a water proofed seam, will slide to and fro. In some instances, the flexing applied to the frame is torsional which may cause one panel at the top end of the seam to buckle inwardly and the same panel at the lower end of that seam to buckle outwardly. While there are many failure modes, they typically result from jarring and flexure of the frame. The same is also true even after the frame of the mobile home has been placed on anchor blocks. Normally it is towed with two or three sets of tires located at the mid-portion. This enables the remote ends to droop and hang downwardly by a fraction of an inch. Both of the opposite ends of the prefab building droop in the same way. Then. when the towing trip is over and the transportation is complete, and the devise is then installed, it often is positioned on corner located props. At that time, the tires may be deflated or even removed. The frame of the mobile home or prefab structure again is warped. Again, seams between adjacent weather panels will show evidence of shifting. An externally installed bead of caulking material is effective for just a few months or a few years, especially when the frame is bent with a move.

It is possible to seal the gap between adjacent weather panels but that it somewhat difficult with other mechanisms. Where the panels are quite thick, that can be done differently. Where relatively thin, it is somewhat more difficult to grip the panels with an external strip. To the extent that the strip is located externally, it is supported only at narrow marginal widths along the thickness of the panels. With thin panel construction, that is generally an inadequate grip. Since the grip is inadequate, it is easy for the panel protective strips to pop loose. This is true especially when the frame is twisted during transportation. Then, when the prefab building is positioned at one location, the frame may be bent, first arching in a concave and then in a convex fashion, thereby breaking or otherwise dislodging edge located protective strips.

The present disclosure is directed to an improved protective strip. It is constructed especially for prefab housing or mobile homes. It is preferably constructed in the fashion of a Tee having a central spline which is centered along the backing and the spline extends outwardly in the gap between adjacent panels. In the optimum situation, the spline is positioned at the desired location and is nailed in place by nailing the strip to adjacent frame members. This can be done so that the strip of the present disclosure is anchored. Moreover, this permits anchoring so that the wall can be assembled with a high quality seam between adjacent weather panels which does not permit water penetration. By excluding water, the life and durability of the fabricated wall is extended remarkably. Moreover, the ability to shed water notwithstanding modest shifts in position between adjacent panels enables the prefab building or mobile home to be towed more readily. The vibrations encountered during travel do not pose as great a problem.

In summary, the present disclosure sets forth a system in which a Tee shaped strip is installed between adjacent panels, positioned on the inside of the seam, thereby providing an improved water proof joint. This joint more readily excludes water and prevents entry of water. Beyond that, it excludes air leaks so that the thermal loss of heating or cooling is improved. Finally, it improves and makes more readily durable the protection to the frame members. In one embodiment, the strip of the present disclosure protects the installed frame members, typically being single or double 2×4s. Finally, the strip of the present disclosure assures protection and prevents unwanted water entry so that the passage of time does not harm or damage either the fabricated skin at the exterior or create rot on the interior frame. It especially protects the frame members so that they do not require water proofing materials.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrates only a typical embodiment of this invention and is therefore not to be considered limiting of its scope, for the invention may add to other equally effective embodiments.

DETAILED DESCRIPTION OF THE INVENTION

Figure 1:
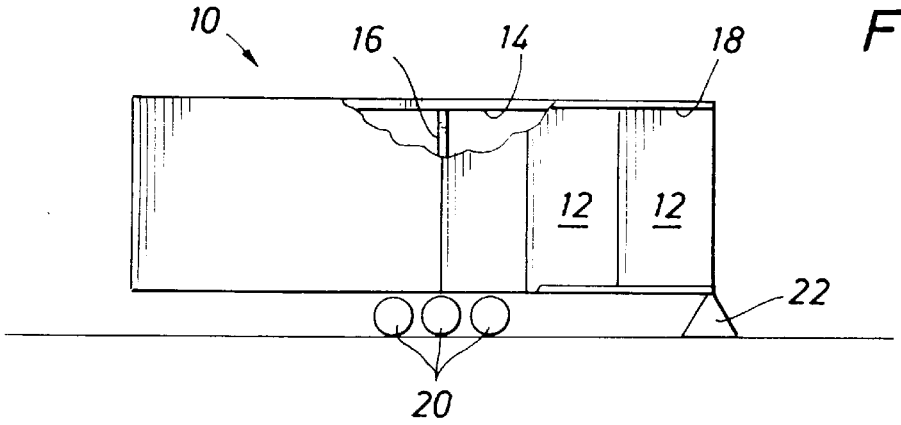
FIG. 1 is a side view of a prefab building which is mounted on tires and which is moved to a location, and further illustrates a portion of the wall broken away to show how adjacent panels are joined side-by-side.

Attention is now directed to FIG. 1 of the drawings where a mobile home or prefab building 10 is illustrated. Assume for purposes of description that it is formed with a rectangular profile. The walls are ideally about 8 feet tall, and it will discussed and described under the assumption that the walls are made of a set of panels which are 4×8. To this end, the panels are identified by the numeral 12 and they define adjacent seams. Speaking generally, the prefab building in this instance has a horizontal frame member 14 and a vertical stud 16. There is all external L-shaped bracket 18 on the exterior. This seals over the skin along the frame members 14 and 16 at the upper end. The frame members are connected to define the entire structure. Permanent or demountable tires are shown at 20. Typically, there will be a tow hitch or other tongue mounted structure which connects with the frame. This enables the prefab building 10 to be towed to a particular location. It has a length anywhere from about 20 to perhaps 80 feet. Over length structures are made depending on the requirements of the prefab building. At the time of towing, all the weight is supported at the middle. The installed tires 20 may be removed, deflated or replaced with blocks underneath the frame. The frame can be raised by blocking under the structure. A typical support 22 is shown Linder one end, and similar support(s) are furnished at the opposite end. It is not uncommon to support the frame of the building 10 with four, six or eight pilings. They are located along the two edges and typically at the corners of the two sides. The mid-portion may or may not be supported.

With four or more supports under the framed building, there still remains the reality of arcuate bending downwardly where the left and right ends droop while towing and they are bent upwardly when rested on the supports 22. This curvature of the frame remains relatively small. Whether curved in a concave or convex fashion, this bowing tends to distort the frame and thereby causes the adjacent panels 12 to slide against each other. Not only may they slide relatively, they may also wiggle and jiggle when subjected to bumps during transit. Thus, the structure may be slightly distorted with some modest curvature after manufacture but while being stored before delivery, it is later exposed to bouncing and vibration when traveling from the point of fabrication to the point of installation, and then bowing occurs in another fashion when the structure is installed at the final destination. It can be bowed downwardly, shaken badly, and then bowed upwardly, all as a result of the sequence of installation, towing and erection.

Without regard to the manner of harm inflicted on the structure, the seam between the adjacent panels 12 is subjected to significant wear and tear. This will impact the hermetic seal formed at the adjacent panels. If water proof and air tight at the time of manufacture, that virtue is preserved by the present invention. Suffice it to say, the strip of the present disclosure provides remarkable extension of life to the hidden frame work which includes the frame member 14 and the stud 16 exemplified in FIG. 1.

Figure 2:
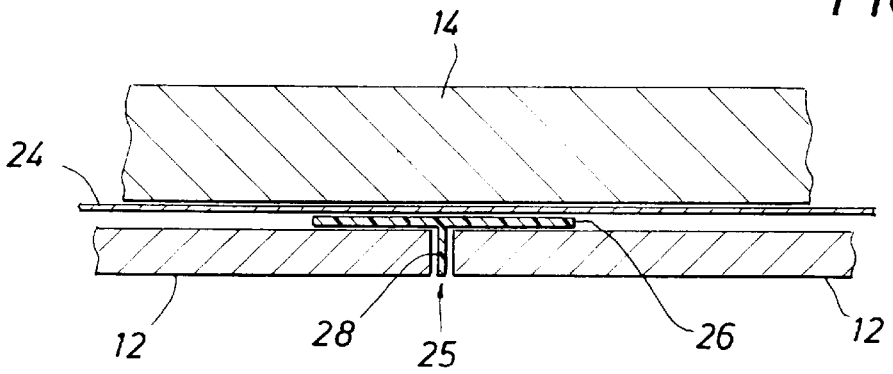
FIG. 2 is a sectional view through the strip of the present disclosure installed between a pair of adjacent panels to close the seam between the panels and showing a top frame member for anchoring the strip.

Attention is now directed to FIG. 2 of the drawings. This is a sectional view through the frame member 14 which is covered over by the weather panels 12. The panels are abutted against each other to define a joint which requires protection against weather. In this particular instance, it is shown with a sheet of protective film such as felt, paper or other sheet material. The sheet 24 is incorporated for that purpose. The sheet 24 is sometimes omitted in some prefab buildings. It is not always included; if included, the sheet material 24 is located on inside of the panels 12. The present disclosure is concerned with a protective strip 25. It is located at the edges between the weather panels 12. It has the form of a Tee as viewed in cross-section. As will be elaborated, the dimensions of the Tee are significant in relation to the prefab building. The scale of the materials in FIG. 2 should be noted. The abutted panels 12 are relatively thin. Indeed, they can have a thickness as little as 0.125 inches; the preferred fiber-cement panel is about 0.3125 inches. Not only are they relatively thin, they are flexible and able to bend in a limited extent. Considering, however, the 8 foot height of the panels, they can bow or buckle by a substantial amount. Therefore, the view of FIG. 2 is idealized in that the panels 12 are intended to be precisely abutted and aligned, and are evenly cut so that they maintain uniform contact along the installed strip 25. This idealized description preferably is even assisted by the strip 25 which is placed between the two panels, the scam being 8 feet in height. The frame member 14 is located on the back side of the panels 12. Assume for the moment that the panels have an exposed weather face which is a skin or surface weather resistant treatment. That skin is incorporated to assure all weather exposure at the time the prefab building is installed. Through the seasons, a skin is required to shed water so that none enters the panel and damages the panel material. This strip 25 is installed to assist in that regard also. The strip 25 has a back plate 26 which has a thickness of perhaps 0.03 to about 0.08 inches, and has a width of at least 1.5 inches. The preferred width is 3 inches. The preferred thickness is about 0.045 which is sufficient thickness for rigidity and durability without undue bending. There is a significance to this for certain wall frame construction dimensions. The strip, in addition, includes an upstanding spline 28. The spline has a thickness which has been exaggerated along with the panels 12 in the present view. The spline preferably has a height approximately equal to or less than the thickness of the panels 12. Those panels can be relatively thin, the typical material having a thickness given above. The spline 28 has a thickness in the range of 0.03 to about 0.15 inches. The spline 28 is about 0.0625 inches shorter in height compared to the panels. This defines a slot for receiving a small bead of caulking to supplement the seal. The seal is primarily dependent on the strip. While it can be made thicker, there is no particular gain in greater thickness.

Figure 3:
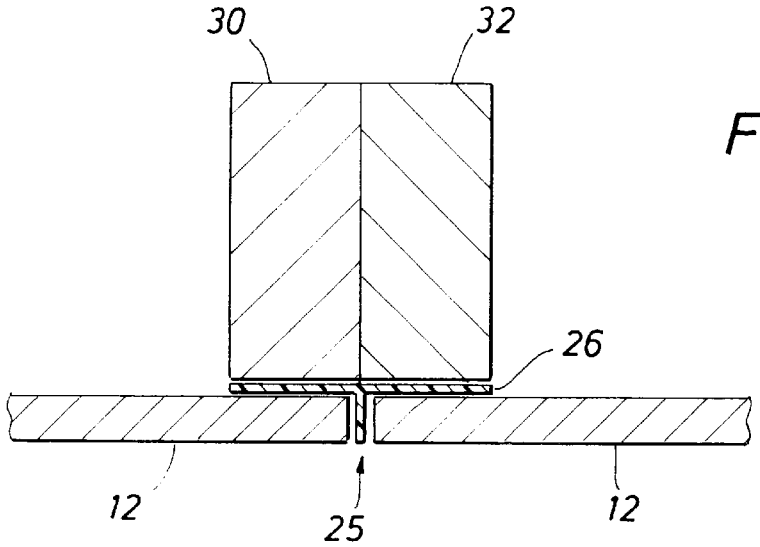
FIG. 3 is a sectional view through the strip of the present disclosure illustrating the installation of the strip adjacent to frame members which are abutted against the strip and protected by the strip to prevent rotting.
Figure 4:
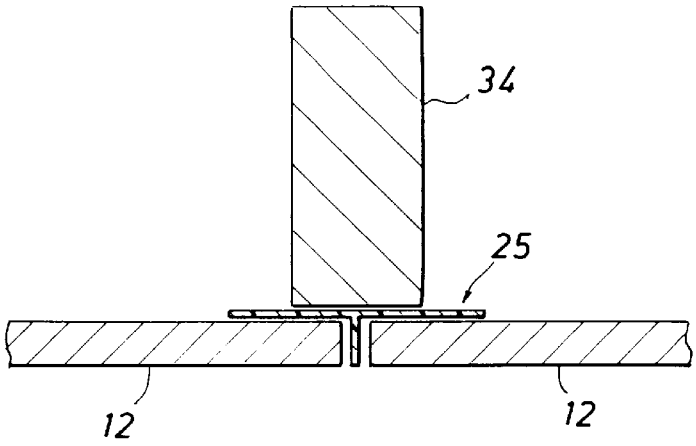
FIG. 4 is a view similar to FIG. 3 featuring only a single frame member.

As illustrated, the spline 28 is normal to the back 26. The back 26 has a width of 3.0 inches so that it will align up adjacent to a frame construction featuring adjacent 2×4s. FIG. 3 shows one frame construction where adjacent vertical boards 30 and 32 are illustrated. When using 2×4 frame members, the cumulative width of the pair is about 3 inches. The back plate 26 is centered with respect to the pair of frame members so that both frame members are protected against the intrusion of rain water. The frame members are protected to the left and right of the seam by a width of about 1.5 inches. Using this dimension, both of the frame members are protected from water intrusion. The pathway that water would have to follow is relatively long. Even should a drop or two of water get behind the panel members, as might occur where there is a ding or chip from the edge of one of the panels, the water is required by capillary wetting to flow around the edge of the strip 25. Often, there simply is not enough water to cover that great a distance and thereby contact the frame members 30 and 32. The protection to the frame member is even greater as illustrated in FIG. 4. The panel members 12 again are separated by the strip 25 but the strip in this instance is positioned adjacent to only a single frame member 34. Assuming the frame member 34 has the normal size, a width of about 1.5 inches, flow of water by capillary contact and wetting around the face of the strip is significantly limited. The strip is not a perfect barrier but it is quite effective in water exclusion.

At the time of installation, the strip 25 typically is placed finder the edge of one panel member prior to the assembly of the second panel. At that stage, small headed nails are driven through the strip 25 into the frame 34. This is repeated at three or four locations along the frame 34. The grip of the nails along with the tight grip to the strip prevents the flow of water into the nail holes. In effect, the holes formed by nailing are self-healing in the sense that water on the exterior does not routinely flow next to the nail because there is no room for capillary wetting. By nailing the strip 25 to the frame member behind it, the water exclusion feature is not compromised. Rather, water is excluded at this location.

Figure 5:
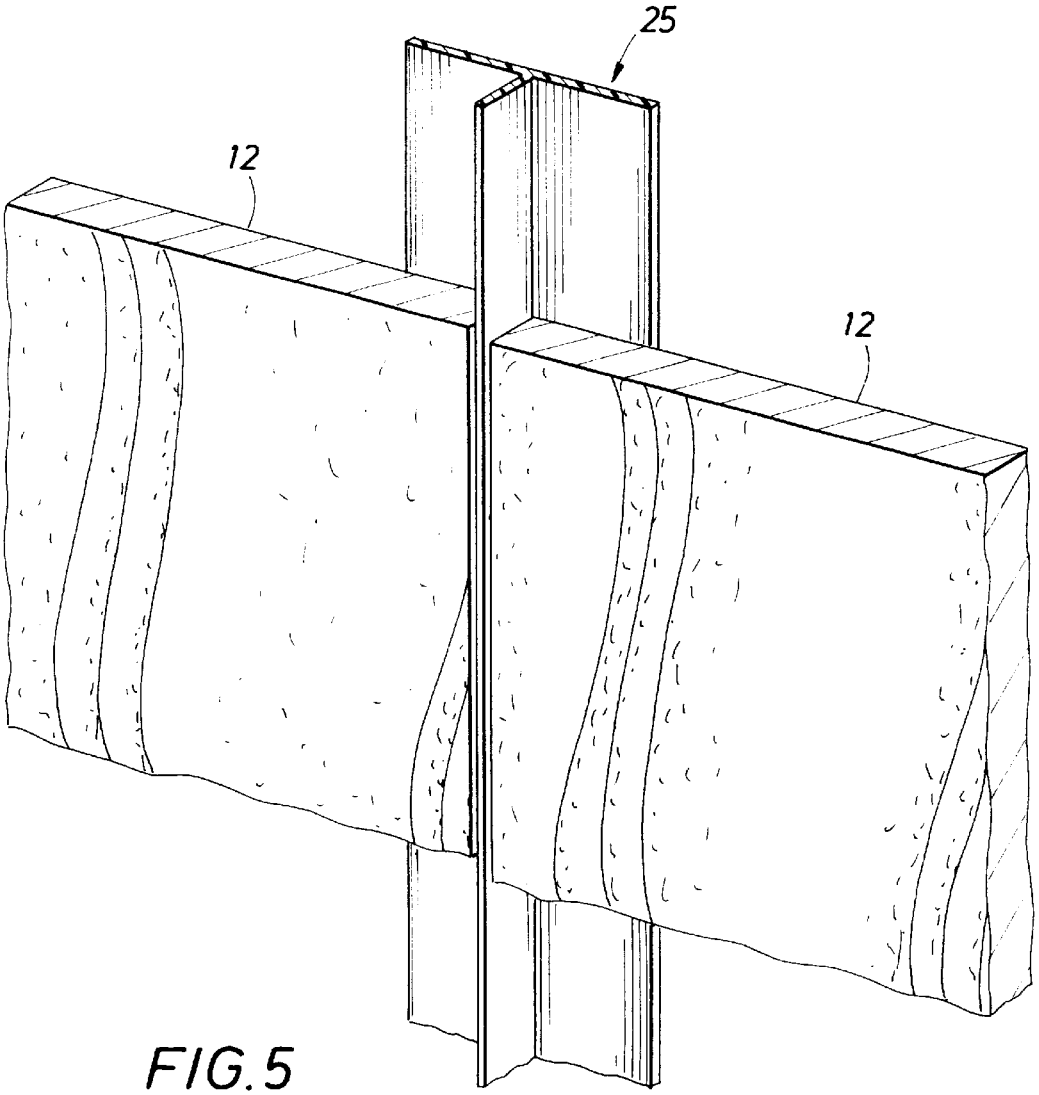
FIG. 5 is a perspective view of the strip of the present invention between a pair of adjacent panels.

Attention is now directed to FIG. 5 of the drawings. It shows the strip 25 with adjacent panels 12, and the panels 12 arc locked in place in the same manner. The strip 25 is abutted snugly against both of the panels 12. Cosmetically, the strip is exposed along the bead of the upstanding spline 28 and is only slightly visible. It is relatively short so that it does not significantly protrude nor does it cast a shadow when lighted from one side. Without the use of any caulking material, but by nailing the panels in place and clamping them by the L-shaped bracket 18 and comparable brackets along the lower edges, the panels are snugly held against the wall and do not have significant tendencies of popping loose. So to speak, each panel is held and pressed against the strips along the edges of the panel. Since the panels 12 are connected to one or two strips along adjacent edges, those edges maintain sufficient facial pressure and contact so that the strip 25 continues the water exclusion virtue long after fabrication. Even when the prefab building is moved supported by the tires 20, relative movement of adjacent panels does not pose a problem of breaking any seal material at the seam. Should there be even the smallest to largest movement between the panels 12, there is no caulking material in the seam and no likelihood of fracture.

The T-shaped strip 25 is fabricated by extrusion of polyvinyl material. A mold of the appropriate shape forms the strip. To reduce cost, the strip material need not be provided with UV blocking material in the compound. Preferably, it is somewhat bendable or flexible. In the event that building settling occurs and the frame is warped in some way, the warp will not damage, break or distort the strip causing a localized failure.

As best illustrated in the drawings, and in particular with regard to the cross sectional views, it will be observed that the strip of the present invention is ideally positioned between adjacent members 12 and has the protruding spline which is ideally made as a T-shaped, single piece protective strip which has a back plate which is essentially flat, planar, solid, monolithic and smooth sided. In addition, the spline is preferably a flat, planar, solid, monolithic, smooth sided protruding planar member at approximately right angles with respect to said back plate, and the preferred version utilizes a spline having a thickness of about 0.03 inches or greater.

The prefab building 10 may have several seams around it. Each seam is protected with a strip. Each seam is preferably secured in the same fashion with the same construction techniques. In practice, incorporation of the strip 25 at every seam protects the same and thereby extends the life of the prefab building. With extended life, protection is assured for a much longer interval.

While the foregoing is directed to the preferred embodiment, the scope is determined by the claims which follow.

I claim:

1. A prefab building or mobile home wall construction consisting essentially of:

(a) an underlying frame member;

(b) overlying weather panels defining a seam adjacent to or crossing over said frame member wherein each, said weather panel defines an edge and said panel edges are positioned at said seam to define said seam;

(c) a lengthwise T-shaped, single piece, protective strip positioned behind said panels and having a flat, planar, solid, monolithic, smooth-sided back plate with an elongate flat, planar, solid, monolithic, smooth-sided spline therealong positioned and clamped with said spline between said panels and said panels clamp said strip so that water intrusion is limited;

(d) said panels have a common surface defining a building outer wall surface and said frame is protected in said wall by said strip to reduce water intrusion and related damage; and (e) said protective stay spline is at a right angle to said back plate and centered between a pair of parallel edges and wherein said spline has a height equal to or less than the thickness of said weather panels.

2. The construction of claim 1 wherein said strip comprises said back plate and said back plate is equal to or greater in width to said frame member.

3. The construction of claim 2 wherein said back plate is about 3 inches wide.

4. The construction of claim 1 wherein said spline is at least about 0.03 inches thick.

5. The construction of claim 4 wherein said strip has a width at said back plate spanning the seam between said weather panels and said spline is centered between said panels to define said seam.

6. The construction of claim 1 wherein said strip comprises said back plate and said back plate is greater in width than said frame member.

7. The construction of claim 6 wherein said frame member is about 1.5 inches wide.

8. A prefab building construction wherein the building is constructed of a frame and has an exterior wall surface covering said frame and exposed to inclement weather and rain, and said prefab building construction consisting essentially of:

(a) a frame member;

(b) first and second adjacent weather panels defining said exterior wall surface and abutted along edges thereof to define a seam adjacent to or crossing over the frame member;

(c) a T-shaped, single piece protective strip under the adjacent weather panels and extending along the seam therebetween wherein the strip incorporates a flat, planar, solid, monolithic, smooth-sided spline, wherein the strip is positioned under said adjacent panels;

d) wherein said spline is a right angle to back plate and centered between a pair of parallel edges, and wherein said spline has a height equal to or less than the thickness of said weather panels; and (e) wherein said back plate is equal to or greater in width to said frame member.

9. The construction of claim 8 wherein said frame member is about 1.5 inches wide.

10. The construction of claims 8 wherein said strip has a width at said back plate spanning the seam between said weather panels and said spline is centered between said panels to define said seam.

* * * * *